US009464536B2

(12) United States Patent
Zhang et al.

(10) Patent No.: US 9,464,536 B2
(45) Date of Patent: Oct. 11, 2016

(54) SEALING ARRANGEMENT FOR A TURBINE SYSTEM AND METHOD OF SEALING BETWEEN TWO TURBINE COMPONENTS

(71) Applicant: General Electric Company, Schenectady, NY (US)

(72) Inventors: Xiuzhang James Zhang, Simpsonville, SC (US); Gary Michael Itzel, Simpsonville, SC (US); Ibrahim Sezer, Greenville, SC (US)

(73) Assignee: General Electric Company, Schenectady, NY (US)

( * ) Notice: Subject to any disclaimer, the term of this patent is extended or adjusted under 35 U.S.C. 154(b) by 900 days.

(21) Appl. No.: 13/654,822

(22) Filed: Oct. 18, 2012

(65) Prior Publication Data

US 2014/0112753 A1 Apr. 24, 2014

(51) Int. Cl.
*F01D 11/12* (2006.01)
*F01D 11/00* (2006.01)

(52) U.S. Cl.
CPC ..... *F01D 11/006* (2013.01); *F01D 11/122* (2013.01)

(58) Field of Classification Search
CPC .... F01D 11/005; F01D 11/006; F01D 11/08; F01D 11/12; F01D 11/122; F01D 5/20; F05D 2240/11; F05D 2240/55
See application file for complete search history.

(56) References Cited

U.S. PATENT DOCUMENTS 3,425,665 A 2/1969 Lingwood
3,575,523 A * 4/1971 Gross, Jr. ..... F01D 5/20 415/171.1
4,269,903 A * 5/1981 Clingman ..... C23C 4/18 415/173.4
4,551,064 A 11/1985 Pask
5,071,313 A 12/1991 Nichols
5,125,798 A 6/1992 Muth et al.
5,161,944 A 11/1992 Wood
5,178,529 A * 1/1993 Obrist ..... F01C 21/104 277/411
5,188,506 A 2/1993 Creevy et al.
5,380,150 A 1/1995 Stahl
5,536,143 A 7/1996 Jacala et al.
5,822,852 A 10/1998 Bewlay et al.
5,988,975 A 11/1999 Pizzi
6,027,306 A * 2/2000 Bunker ..... F01D 5/20 415/115
6,340,285 B1 1/2002 Gonyou et al.
6,350,102 B1 * 2/2002 Bailey ..... F01D 5/20 415/173.5
6,406,256 B1 6/2002 Marx
6,554,566 B1 4/2003 Nigmatulin
6,602,052 B2 8/2003 Liang
6,739,593 B2 * 5/2004 Fried ..... F01D 11/02 277/411
6,932,566 B2 8/2005 Suzumura et al.
6,962,342 B2 * 11/2005 Wieghardt ..... F01D 11/122 277/411
6,971,851 B2 12/2005 Liang
6,984,106 B2 1/2006 Thompson
7,207,771 B2 4/2007 Synnott et al.
7,210,899 B2 5/2007 Wilson, Jr
7,217,089 B2 5/2007 Durocher et al.
7,473,073 B1 1/2009 Liang (Continued)

*Primary Examiner* — Craig Kim
*Assistant Examiner* — Brian O Peters
(74) *Attorney, Agent, or Firm* — Fletcher Yoder, P.C.

(57) ABSTRACT

A sealing arrangement for a turbine system includes a bucket having an outer tip and at least one bucket ridge extending radially outwardly from the outer tip, the at least one bucket ridge comprising an abradable material. Also included is a stationary shroud disposed radially outwardly from the outer tip of the bucket. Further included is at least one shroud ridge extending radially inwardly from the stationary shroud toward the outer tip of the bucket, the at least one shroud ridge comprising the abradable material.

24 Claims, 7 Drawing Sheets

(56) References Cited

U.S. PATENT DOCUMENTS

| | | | | |
|---|---|---|---|---|
| 7,494,319 | B1 | 2/2009 | Liang | |
| 7,513,738 | B2 | 4/2009 | Itzel et al. | |
| 7,513,743 | B2 | 4/2009 | Liang | |
| 7,527,475 | B1 | 5/2009 | Liang | |
| 7,597,539 | B1 | 10/2009 | Liang | |
| 7,641,444 | B1 | 1/2010 | Liang | |
| 7,645,123 | B1 | 1/2010 | Liang | |
| 7,704,039 | B1 | 4/2010 | Liang | |
| 7,704,047 | B2 | 4/2010 | Liang et al. | |
| 7,740,442 | B2 | 6/2010 | Lee et al. | |
| 7,740,445 | B1 | 6/2010 | Liang | |
| 7,811,054 | B2 | 10/2010 | Eastman et al. | |
| 7,922,451 | B1 | 4/2011 | Liang | |
| 7,934,906 | B2 | 5/2011 | Gu et al. | |
| 7,997,865 | B1 | 8/2011 | Liang | |
| 8,011,889 | B1 | 9/2011 | Liang | |
| 8,043,058 | B1 | 10/2011 | Liang | |
| 8,043,059 | B1 | 10/2011 | Liang | |
| 8,061,987 | B1 | 11/2011 | Liang | |
| 8,066,485 | B1 | 11/2011 | Liang | |
| 8,100,640 | B2 | 1/2012 | Strock et al. | |
| 8,113,779 | B1 | 2/2012 | Liang | |
| 9,057,279 | B2 * | 6/2015 | Lotfi | F01D 11/02 |
| 2003/0082053 | A1 | 5/2003 | Jackson et al. | |
| 2005/0196277 | A1 | 9/2005 | Wang et al. | |
| 2005/0232752 | A1 | 10/2005 | Meisels | |
| 2006/0078429 | A1 | 4/2006 | Darkins, Jr. et al. | |
| 2006/0228209 | A1 * | 10/2006 | Couture | F01D 11/001 415/174.2 |
| 2007/0224049 | A1 | 9/2007 | Itzel et al. | |
| 2008/0131264 | A1 | 6/2008 | Lee et al. | |
| 2010/0232940 | A1 | 9/2010 | Ammann | |
| 2011/0052367 | A1 | 3/2011 | Martin et al. | |
| 2011/0217155 | A1 | 9/2011 | Meenakshisundaram et al. | |
| 2012/0230818 | A1 * | 9/2012 | Shepherd | F01D 5/20 415/208.1 |
| 2013/0017072 | A1 * | 1/2013 | Ali | F01D 11/02 415/174.4 |

* cited by examiner

SEALING ARRANGEMENT FOR A TURBINE SYSTEM AND METHOD OF SEALING BETWEEN TWO TURBINE COMPONENTS

BACKGROUND OF THE INVENTION

The subject matter disclosed herein relates to turbine systems, and more particularly to a sealing arrangement for such turbine systems, as well as a method of sealing between two turbine components.

In turbine systems, such as a gas turbine system, a combustor converts the chemical energy of a fuel or an air-fuel mixture into thermal energy. The thermal energy is conveyed by a fluid, often compressed air from a compressor, to a turbine where the thermal energy is converted to mechanical energy. As part of the conversion process, hot gas is flowed over and through portions of the turbine as a hot gas path. High temperatures along the hot gas path can heat turbine components, causing degradation of components.

A turbine section shroud is an example of a component that is subjected to the hot gas path and often comprises two separate regions, such as an inner shroud portion and an outer shroud portion, with the inner shroud portion shielding the outer shroud portion from the hot gas path flowing through the turbine section. Numerous sealing arrangements have been employed to attempt to adequately seal paths through which the hot gas may pass to the outer shroud portion. Unfortunately, various shroud sealing arrangements allow the leakage and propagation of hot gas through the inner shroud portion to the outer shroud portion.

Another region of concern with respect to hot gas leakage due to inadequate sealing is proximate an outer tip of a rotating bucket and a stationary shroud surrounding the rotating bucket. The region is typically reduced as much as possible, without adversely affecting the rotating bucket performance. As the hot gas, or working fluid, flows through the hot gas path, thereby causing rotation of the buckets, any leakage occurring between the outer tip of the bucket and the surrounding stationary shroud results in wasted energy and leads to reduced overall efficiency of the turbine system.

BRIEF DESCRIPTION OF THE INVENTION

According to one aspect of the invention, a sealing arrangement for a turbine system includes a bucket having an outer tip and at least one bucket ridge extending radially outwardly from the outer tip, the at least one bucket ridge comprising an abradable material. Also included is a stationary shroud disposed radially outwardly from the outer tip of the bucket. Further included is at least one shroud ridge extending radially inwardly from the stationary shroud toward the outer tip of the bucket, the at least one shroud ridge comprising the abradable material.

According to another aspect of the invention, a sealing configuration for a turbine system includes a shroud assembly extending circumferentially around at least a portion of a turbine section. Also included is a radially inner region of the shroud assembly comprising a plurality of circumferential segments, each of the circumferential segments having a gap disposed therebetween, the gap defined by a first surface of a first circumferential segment and a second surface of an adjacent circumferential segment.

According to yet another aspect of the invention, a method of sealing between two turbine components is provided. The method includes forming a first ridge along a first turbine component, the first ridge extending away from the first turbine component and comprising an abradable material. Also included is forming a second ridge along a second turbine component, the second ridge extending away from the second turbine component into close proximity with the first ridge and comprising an abradable material.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
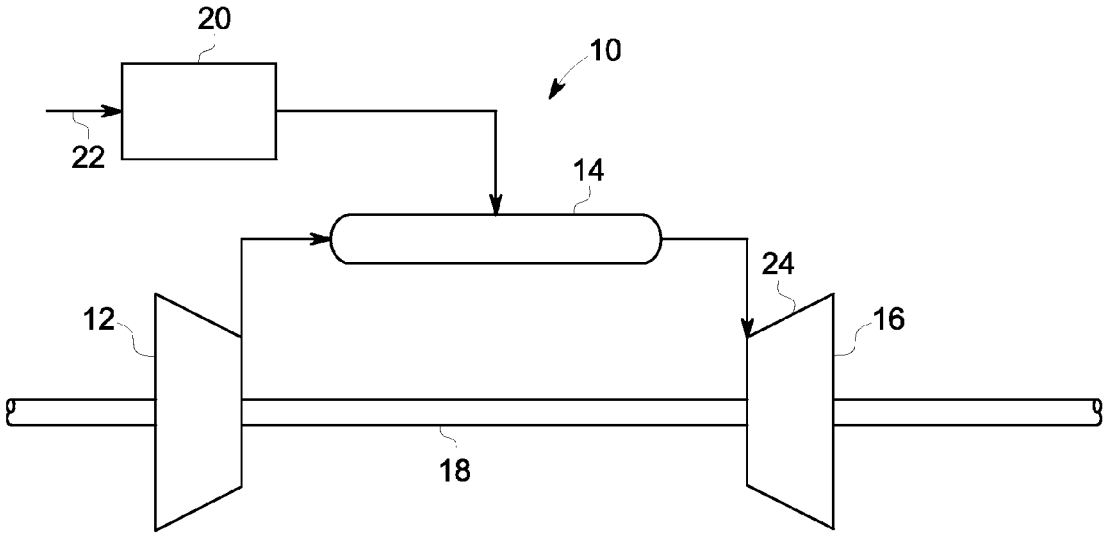
FIG. 1 is a schematic illustration of a turbine system.

Referring to FIG. 1, a turbine system, such as a gas turbine system, is schematically illustrated with reference numeral 10. The gas turbine system 10 includes a compressor section 12, a combustor section 14, a turbine section 16, a shaft 18 and a fuel nozzle 20. It is to be appreciated that one embodiment of the gas turbine system 10 may include a plurality of compressor sections 12, combustor sections 14, turbine section 16, shafts 18 and fuel nozzles 20. The compressor section 12 and the turbine section 16 are coupled by the shaft 18. The shaft 18 may be a single shaft or a plurality of shaft segments coupled together to form the shaft 18.

The combustor section 14 uses a combustible liquid and/or gas fuel, such as natural gas or a hydrogen rich synthetic gas, to run the gas turbine system 10. For example, the fuel nozzles 20 are in fluid communication with an air supply and a fuel supply 22. The fuel nozzles 20 create an air-fuel mixture, and discharge the air-fuel mixture into the combustor section 14, thereby causing a combustion that creates a hot pressurized exhaust gas. The combustor section 14 directs the hot pressurized gas through a transition piece into a turbine nozzle (or "stage one nozzle"), and other stages of buckets and nozzles causing rotation of the turbine section 16 within a turbine casing 24. Rotation of buckets 26 (FIGS. 2-4) within the turbine section 16 causes the shaft 18 to rotate, thereby compressing the air as it flows into the compressor section 12. In an embodiment, hot gas path components are located in the turbine section 16, where hot gas flow across the components causes creep, oxidation, wear and thermal fatigue of turbine components. Reducing the temperature of the hot gas path components can reduce distress modes in the components and the efficiency of the gas turbine system 10 increases with an increase in firing temperature. As the firing temperature increases, the hot gas path components need to be properly cooled to meet service life and to effectively perform intended functionality. Additionally, turbine system efficiency is impacted by appropriate sealing at various regions, with one such region disposed between the bucket 26 and a surrounding component, such as a shroud configuration, as will be discussed in detail below.

Figure 2:
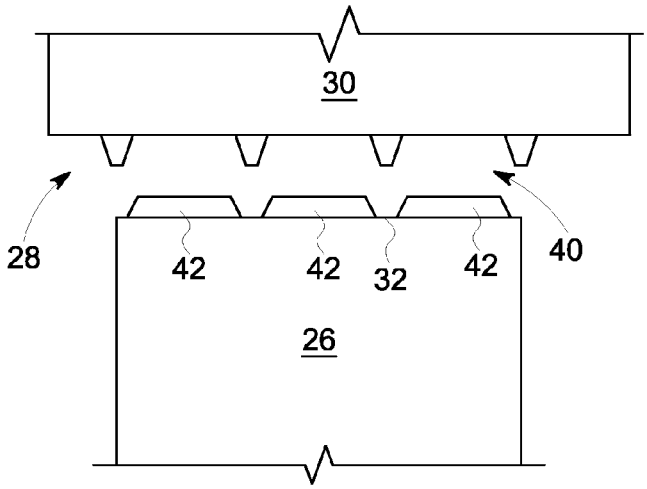
FIG. 2 is a side elevational view of a bucket and a stationary shroud of the turbine system, each of the bucket and the stationary shroud having at least one ridge according to a first embodiment.
Figure 3:
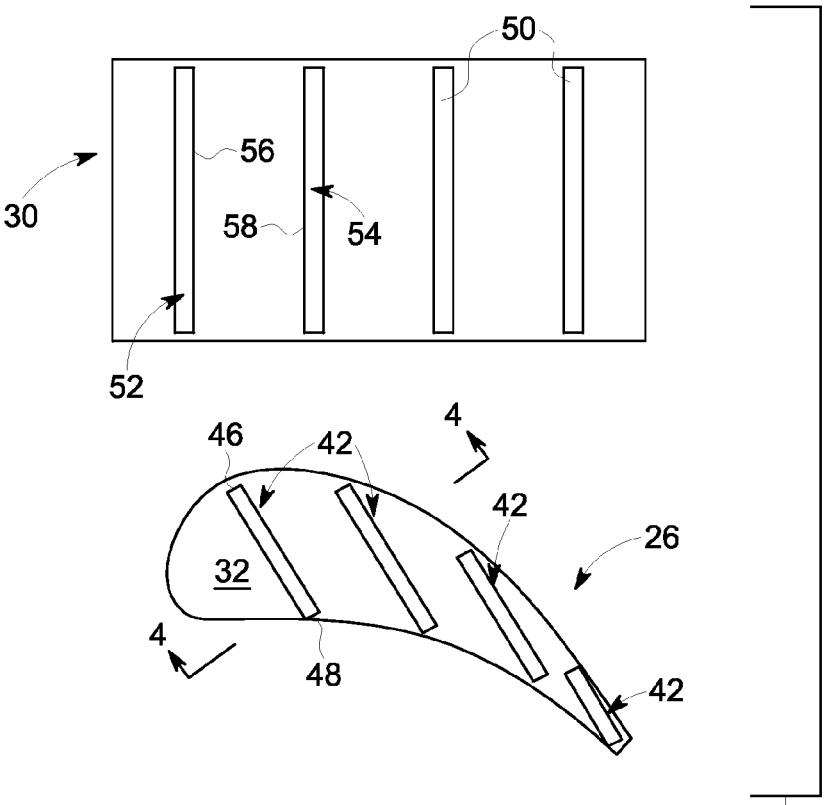
FIG. 3 is a schematic illustration of the bucket and the stationary shroud.
Figure 4:
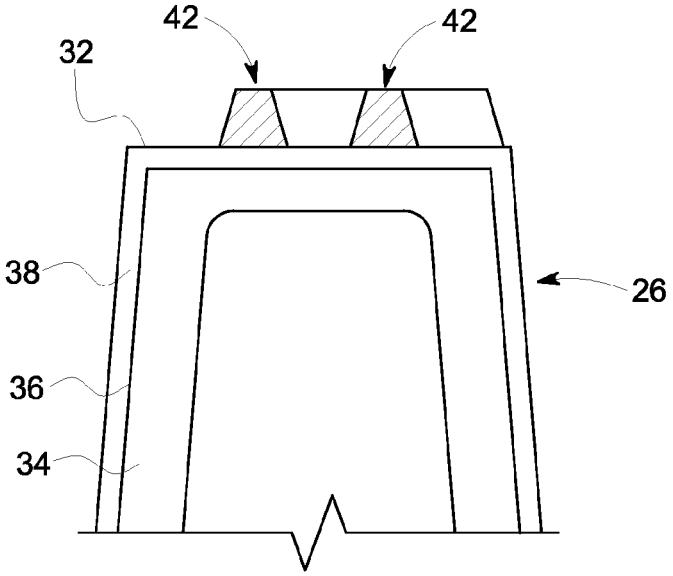
FIG. 4 is a cross-sectional view taken along line A-A of FIG. 3, illustrating the bucket and the at least one ridge according to the first embodiment.

Referring to FIGS. 2-4, a sealing arrangement 28 for a region proximate the bucket 26 and a stationary shroud 30 is illustrated according to a first embodiment. The bucket 26 represents one of several buckets spaced circumferentially from each other that in combination forms a bucket stage (not illustrated). Typically, a plurality of bucket stages are disposed in the turbine section 16. Each bucket stage is surrounded, at least in part, by a shroud assembly that defines an outer boundary of the hot gas path through which the hot gas passes, as described above. The stationary shroud 30 is merely a portion of the shroud assembly, which typically comprises a plurality of stationary shroud segments arranged circumferentially around a corresponding bucket stage.

The bucket 26 extends from a radially inner portion to a radially outer portion that includes an outer tip 32. The outer tip 32 may be formed of various geometries and may include protrusions and/or contours depending on the particular application. In the illustrated embodiment, the outer tip 32 is formed of a relatively planar geometry, thereby providing a relatively flat surface proximate the outer tip 32. The bucket 26 includes a base portion 34 that may include at least a portion of the interior that is hollowed out and the base portion 34 is typically formed of a relatively rigid metal. In one exemplary embodiment, the base portion 34 is coated along at least a portion of an outer surface 36 with a surface coating 38 to provide thermal protection from the hot gas flowing over the bucket 26. The surface coating 38 may include a variety of materials and substances, with one embodiment comprising a thermal barrier coating (TBC) that may be a ceramic such as yttria stabilized zirconia, for example, however, other TBCs may be employed.

As the bucket 26 rotates circumferentially along an axial plane of the turbine section 16, the outer tip 32 comes into close proximity with the stationary shroud 30, with the stationary shroud 30 disposed radially outwardly of the outer tip 32 of the bucket 26. A spacing 40 is typically present between the outer tip 32 and the stationary shroud 30, based on design parameters accounting for thermal expansion, as well as mechanical deformation and deflection of the bucket 26 during operation of the gas turbine system 10. The sealing arrangement 28 is disposed within the spacing 40 to reduce the passage of hot gas through the spacing 40. Passage of hot gas through the spacing 40 reduces the overall efficiency of the gas turbine system 10 based on the loss of work that would have otherwise been done by the hot gas on the bucket 26.

Figure 5:
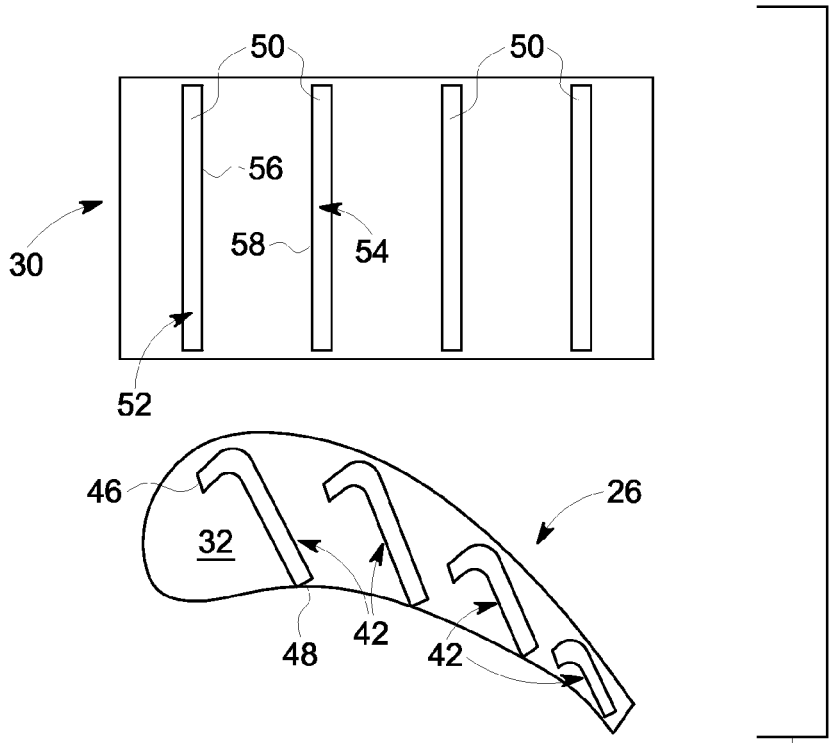
FIG. 5 is a schematic illustrating the at least one ridge according to a second embodiment.
Figure 6:
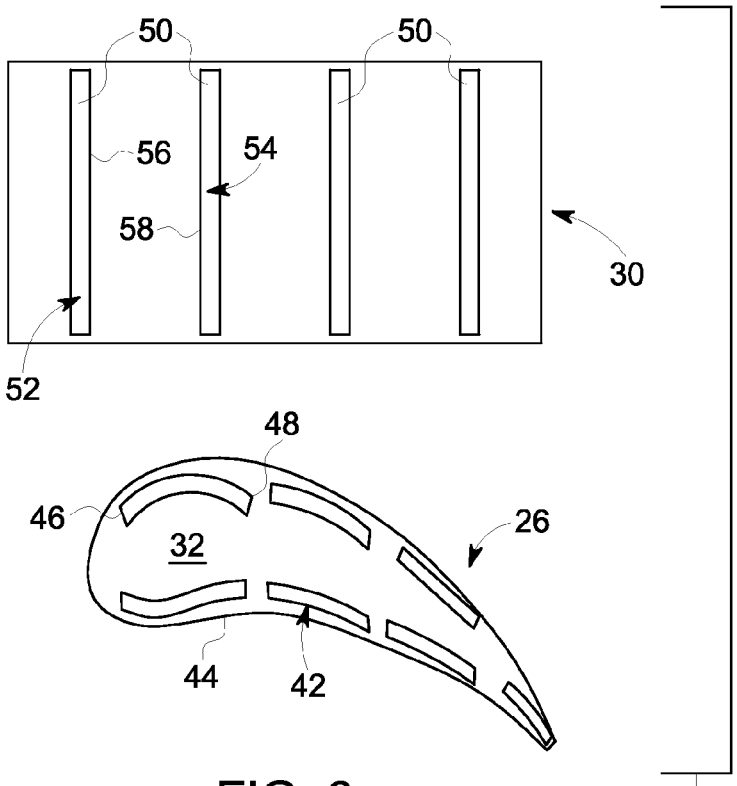
FIG. 6 is a schematic illustrating the at least one ridge according to a third embodiment.

The sealing arrangement 28 includes at least one, but typically a plurality of bucket ridges 42 disposed on the outer tip 32 of the bucket 26. The plurality of bucket ridges 42 extend radially outwardly from the outer tip 32 and may extend axially and/or circumferentially in numerous directions, as shown in alternate embodiments, such as a second embodiment (FIG. 5) and a third embodiment (FIG. 6). The three embodiments illustrated and described herein are merely exemplary embodiments of the plurality of bucket ridges 42 and it is to be appreciated that alternate geometries and dimensions may be employed to suitably accomplish the sealing purposes of the sealing arrangement 28. Furthermore, the plurality of bucket ridges 42 may be positioned in various locations and aligned in numerous configurations, with the plurality of bucket ridges 42 formed of relatively similar or distinct geometries. Referring to the first embodiment shown in FIGS. 2-4, an alignment of relatively similar linearly extending ridges are shown in a relatively parallel alignment. The second embodiment shown in FIG. 5 also illustrates ridges of a relatively similar geometry, specifically what may be characterized as a "J-shape" or "hook" configuration. In contrast, the third embodiment shown in FIG. 6 illustrates an embodiment comprising ridges of dissimilar geometries and extending proximate an outer perimeter 44 of the outer tip 32. It is again emphasized that the precise shape, position of the ridges, alignment relative to other ridges and dimensions may vary and numerous alternate embodiments are contemplated.

Irrespective of the precise configuration of the plurality of bucket ridges 42, each of the ridges includes a first end 46 and a second end 48, with the first end 46 and the second end 48 each located at distinct axial locations along the outer tip 32. The plurality of bucket ridges 42 are formed of an abradable material that is configured to wear away upon contact or rubbing with the stationary shroud 30, or any components associated with the stationary shroud 30. As noted above, the bucket 26 incurs thermal expansion, as well as mechanical deformation and deflection during operation of the gas turbine system 10. Due to these factors, the outer tip 32 may come into close contact with the stationary shroud 30 and the plurality of bucket ridges 42 provide a sealing buffer within the spacing 40 to seal the region and to provide thermal protection for the outer tip 32. Specifically, the abradable material that the plurality of bucket ridges 42 are formed of may be a ceramic similar to the surface coating 38 described above. As is the case with the surface coating 38, the abradable material of the plurality of bucket ridges 42 may include a variety of materials and substances, with one embodiment comprising a TBC that may be a ceramic such as yttria stabilized zirconia, for example, however, other TBCs may be employed. In an exemplary embodiment, the plurality of bucket ridges 42 are formed entirely of the TBC, however, it is contemplated that the abradable material may be formed only partially of the TBC. Irrespective of the precise TBC material employed, a high temperature resistance property is observed and thereby undesirable heating of the outer tip 32 is avoided during contact and rubbing of the plurality of bucket ridges 42 with the stationary shroud 30.

The stationary shroud 30 includes at least one, but typically a plurality of shroud ridges 50 that are similar in many respects to the plurality of bucket ridges 42, however, alignment of the plurality of shroud ridges 50 is distinct from the plurality of bucket ridges 42. The plurality of shroud ridges 50 extend radially inwardly from the stationary shroud 30 and toward the outer tip 32 of the bucket 26. Although illustrated as extending relatively linearly in a predominantly circumferential direction along a single axial plane, it is contemplated that the plurality of shroud ridges 50 may extend axially and/or circumferentially in numerous directions. Furthermore, although illustrated in a parallel alignment, the plurality of shroud ridges 50 may be aligned in a non-parallel alignment. As is the case with the plurality of bucket ridges 42, the precise shape, position of the ridges, alignment relative to other ridges and dimensions may vary and numerous alternate embodiments are contemplated. Similar to the plurality of bucket ridges 42, the plurality of shroud ridges 50 are formed of an abradable material that is configured to wear away upon contact or rubbing with the bucket 26, or any components associated with the stationary shroud 30. It is contemplated that the plurality of shroud ridges 50 are formed of the same abradable material that forms the plurality of bucket ridges 42, such as a TBC that may be a ceramic such as yttria stabilized zirconia, for example. In an exemplary embodiment, the plurality of shroud ridges 50 are formed entirely of the TBC, however, it is contemplated that the abradable material may be formed only partially of the TBC.

As described above, each of the plurality of bucket ridges 42 include the first end 46 and the second end 48 that extend to distinct axial locations along the outer tip 32. In one embodiment the axial locations of the first end 46 and the second end 48 correspond to locations proximate the plurality of shroud ridges 50. Such corresponding locations may include axially disposed edges of the plurality of shroud ridges 50. Specifically, in one embodiment the plurality of shroud ridges 50 comprises a first shroud ridge 52 and a second shroud ridge 54. The first shroud ridge 52 is disposed at an axially forward location relative to the second shroud ridge 54 and includes a first shroud ridge aft edge 56, while the second shroud ridge 54 includes a second shroud ridge forward edge 58. The first end 46 of one of the plurality of bucket ridges 42 is disposed at an axial location proximate the first shroud ridge aft edge 56, while the second end 48 is disposed at an axial location proximate the second shroud forward edge 58. Such a configuration provides a relatively continuous sealing of the spacing 40 between the bucket 26 and the stationary shroud 30.

Figure 7:
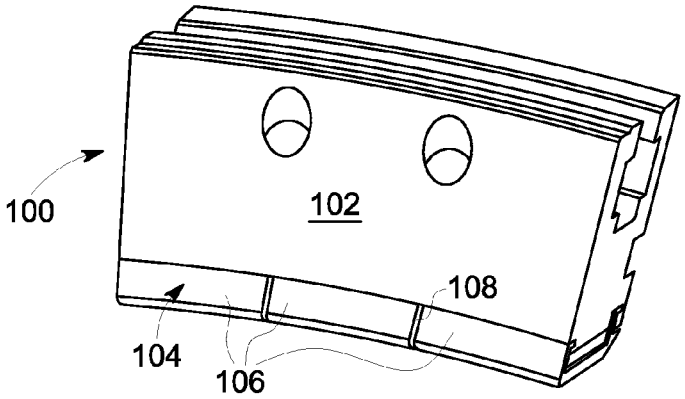
FIG. 7 is a perspective view of a shroud assembly.

Referring now to FIG. 7, another region of the gas turbine system 10 that is sensitive to the hot gas described above is a shroud assembly that is illustrated and generally referred to with numeral 100. The shroud assembly 100 may be formed of a uniform material and structure, however, in one exemplary embodiment the shroud assembly 100 includes an outer shroud region 102 and an inner shroud region 104. The shroud assembly 100 extends circumferentially around at least a portion of the turbine section 16 and, as described above, is spaced radially outwardly from a bucket stage, thereby surrounding a plurality of buckets. The inner shroud region 104 is typically formed of a plurality of circumferential segments 106, with a gap 108 disposed between adjacent segments of the plurality of circumferential segments 106. Specifically, the gap 108 is disposed between, and defined by, a first surface 110 of a first circumferential segment 112 and a second surface 114 of a second circumferential segment 116 disposed adjacent to the first circumferential segment 112, as shown in FIG. 8.

Figure 8:
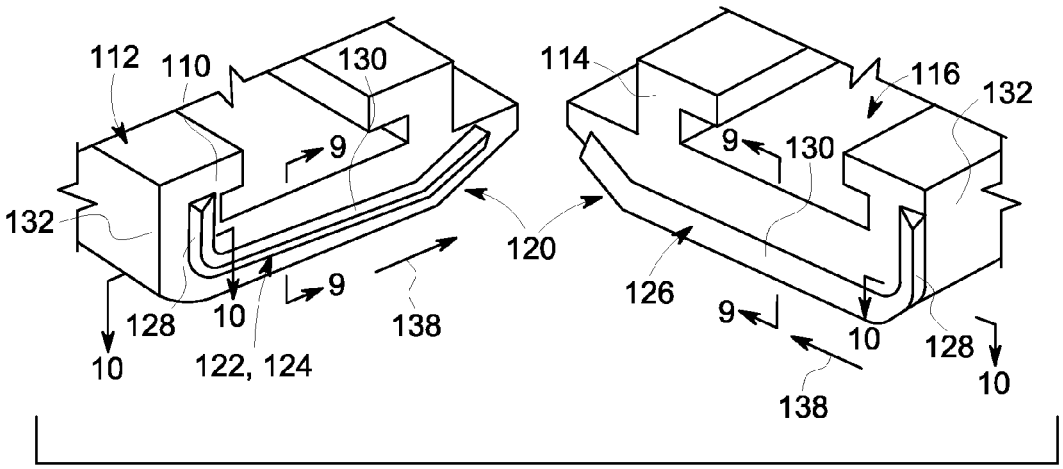
FIG. 8 is a schematic illustration of a sealing configuration according to a first embodiment.
Figure 9:
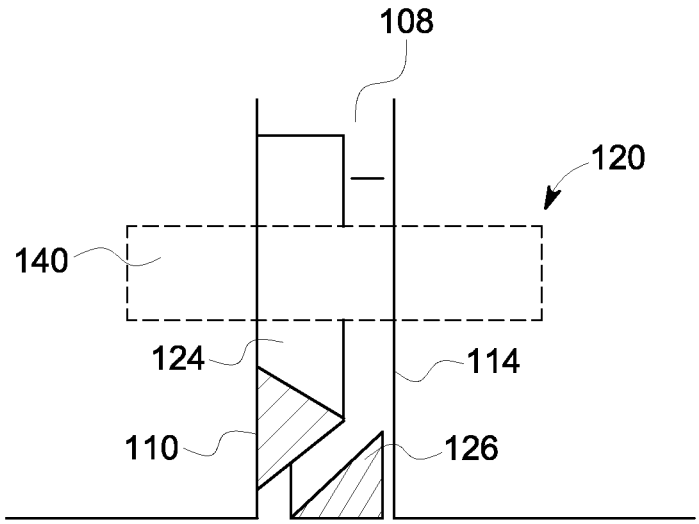
FIG. 9 is a cross-sectional view taken along line B-B of FIG. 8, illustrating the at least one ridge along a relatively axial direction.
Figure 10:
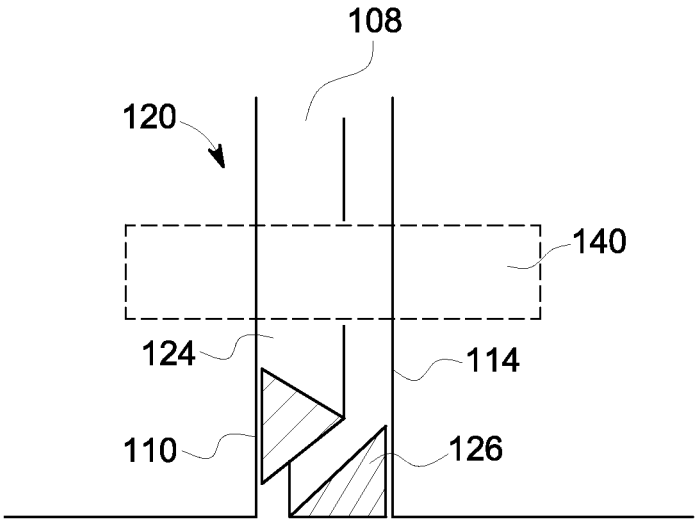
FIG. 10 is a cross-sectional view taken along line C-C of FIG. 8, illustrating the at least one ridge along a relatively radial direction.

Referring now to FIGS. 8-10, a sealing configuration 120 according to a first embodiment is schematically illustrated within the gap 108 between the first circumferential segment 112 and the second circumferential segment 116. The gap 108 is susceptible to leakage of hot gas therethrough to the outer shroud region 102. The sealing configuration 120 reduces the leakage path and includes at least one ridge 122 disposed on at least one of the first surface 110 and the second surface 114, thereby imposing a more torturous path for the hot gas to pass through. As illustrated, it is contemplated that a plurality of ridges are employed. In one embodiment, a first ridge 124 is disposed on the first surface 110 and a second ridge 126 is disposed on the second surface 114. In such an embodiment, the first ridge 124 and the second ridge 126 are disposed at distinct radial locations, such that a staggered relationship is formed between the first ridge 124 and the second ridge 126. It is contemplated that more than two ridges are employed.

The first ridge 124 and the second ridge 126, as well as any additional ridges, may be formed of various geometries, including similar or distinct geometries relative to each other. In the illustrated embodiment, both the first ridge 124 and the second ridge 126 include a relatively radially extending portion 128 and a relatively axially extending portion 130. The relatively radially extending portion 128 is typically located proximate a front surface 132 of the inner shroud region 104, such that the hot gas is impeded from entering the gap 108 in a predominant direction of axial flow 138. The relatively axially extending portion 130 impedes the hot gas from entering the gap in a radial direction as the hot gas flows radially inwardly of the shroud assembly 100. A shroud seal 140 may also be included to further reduce leakage of the hot gas.

The at least one ridge 122 is formed of an abradable material that is configured to wear away upon contact or rubbing with an adjacent circumferential segment of the inner shroud region 104 and provides high temperature resistance, thereby reducing heating of the shroud assembly 100. It is contemplated that the at least one ridge 122 is formed, in whole or in part, of a TBC that may be a ceramic such as yttria stabilized zirconia, for example.

Figure 11:
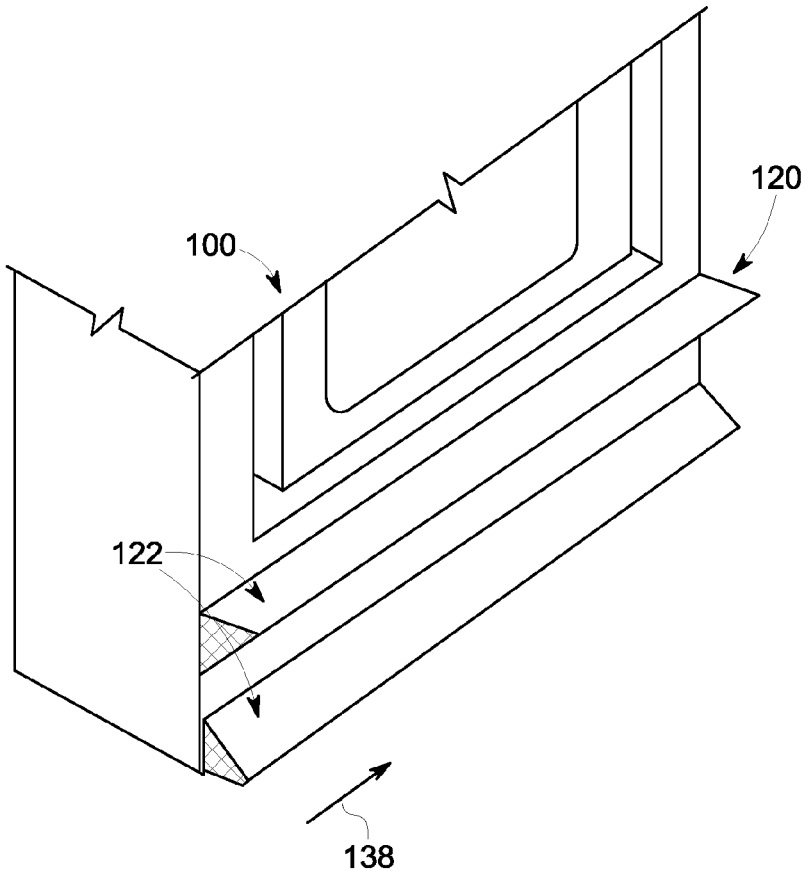
FIG. 11 is a perspective view of the sealing configuration according to a second embodiment.
Figure 12:
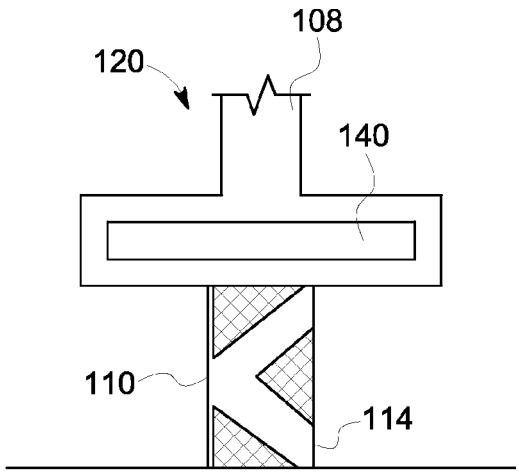
FIG. 12 is cross-sectional view of the sealing configuration according to the second embodiment of FIG. 11.

Referring now to FIGS. 11 and 12, a second embodiment of the sealing configuration 120 is illustrated. Specifically, as described above, the at least one ridge 122 may be formed of various geometries and alignments, with one such embodiment illustrated. The at least one ridge 122 extends in a relatively linear axial direction within the gap 108 along at least one of the first surface 110 and the second surface 114. Similar to the first embodiment, a staggered relationship between the ridges may be formed by disposing the ridges along the first surface 110 and the second surface 114 at distinct radial locations. It is to be appreciated that various alignments and geometries of the ridges may be employed.

Figure 13:
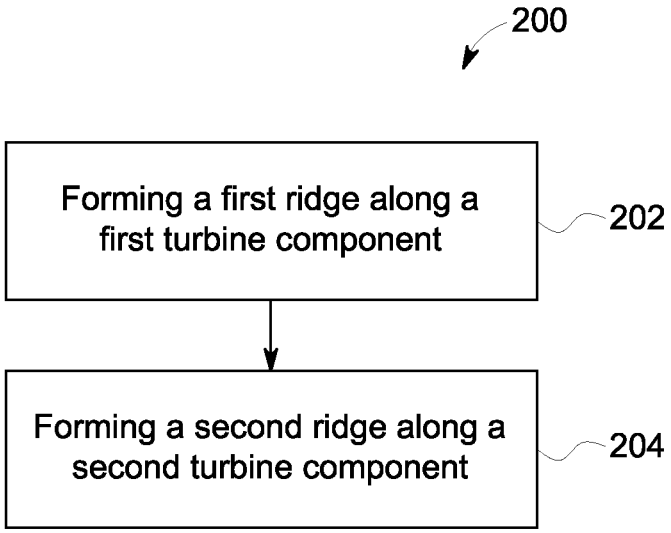
FIG. 13 is a flow diagram illustrating a method of sealing between two turbine components.

As illustrated in the flow diagram of FIG. 13, and with reference to FIGS. 1-12, a method of sealing between two turbine components 200 is also provided. The gas turbine system 10 and associated components have been previously described and specific structural components need not be described in further detail. The method of sealing between two turbine components 200 includes forming a first ridge along a first turbine component 202, with the first ridge extending away from the first turbine component and comprising an abradable material. Also included is forming a second ridge along a second turbine component 204, the second ridge extending away from the second turbine component into close proximity with the first ridge and comprising an abradable material as well.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A sealing arrangement for a turbine system comprising:

a bucket having an outer tip and a plurality of bucket ridges extending radially outwardly from the outer tip, wherein the plurality of bucket ridges extend lengthwise along the outer tip in one or more first directions and comprises a concave or convex curved portion that faces toward a first or a second side between leading and trailing edges, and each of the plurality of bucket ridges comprises an abradable material;

a stationary shroud disposed radially outwardly from the outer tip of the bucket, wherein the stationary shroud comprises an inner surface radially opposite from the outer tip; and a plurality of shroud ridges extending radially inwardly from the inner surface of the stationary shroud toward the outer tip of the bucket, wherein the plurality of shroud ridges extend lengthwise along the inner surface in one or more second directions crosswise to the one or more first directions, a width of a spacing between adjacent shroud ridges of the plurality of shroud ridges is greater than a width of each shroud ridge of the plurality of shroud ridges, the plurality of bucket ridges are staggered relative to the plurality of shroud ridges, and each of the plurality of shroud ridges comprises the abradable material.

2. The sealing arrangement of claim 1, wherein each of the plurality of bucket ridges is entirely formed of the abradable material.

3. The sealing arrangement of claim 1, wherein the plurality of bucket ridges are aligned relatively parallel to each other along the outer tip of the bucket.

4. The sealing arrangement of claim 1, wherein the plurality of shroud ridges are aligned relatively parallel to each other along the inner surface of the stationary shroud.

5. The sealing arrangement of claim 1, wherein each of the plurality of bucket ridges comprises the concave or convex curved portion that faces toward the first or second side.

6. The sealing arrangement of claim 1, wherein the plurality of bucket ridges comprises opposite ridge portions disposed along the opposite first and second sides about an intermediate space.

7. The sealing arrangement of claim 1, wherein the plurality of shroud ridges extend lengthwise along the inner surface in the one or more second directions acutely angled relative to the one or more first directions.

8. The sealing arrangement of claim 1, wherein each bucket ridge of the plurality of bucket ridges comprise a turning portion.

9. The sealing arrangement of claim 1, wherein the abradable material comprises a thermal barrier coating material.

10. The sealing arrangement of claim 9, wherein the thermal barrier coating material comprises yttria stabilized zirconia.

11. The sealing arrangement of claim 1, wherein each bucket ridge of the plurality of bucket ridges extends lengthwise at an acute angle between its adjacent pair of shroud ridges of the plurality of shroud ridges.

12. The sealing arrangement of claim 11, wherein each bucket ridge of the plurality of bucket ridges has a first end disposed proximate to a first one of the adjacent pair of shroud ridges and a second end disposed proximate to a second one of the adjacent pair of shroud ridges.

13. The sealing arrangement of claim 1, wherein each of the plurality of bucket ridges extends lengthwise along the outer perimeter of the outer tip.

14. The sealing arrangement of claim 13, wherein the plurality of bucket ridges are disposed in series along the outer perimeter of the outer tip.

15. A method of sealing between two turbine components comprising:

forming a first plurality of ridges along an outer tip of a first turbine component having opposite first and second sides between leading and trailing edges, wherein the first plurality of ridges extend radially outwardly from the outer tip, wherein the first plurality of ridges extend lengthwise along the outer tip in one or more first directions away from the first turbine component, and wherein each ridge of the first plurality of ridges comprises a concave or convex curved portion that faces toward the first or second side; and forming a second plurality of ridges along a second turbine component comprising an inner surface radially opposite from the outer tip, wherein the second plurality of ridges extend radially inwardly from the inner surface of the second turbine component toward the outer tip, and the second plurality of ridges extend lengthwise along the inner surface in one or more second directions crosswise from the one or more first directions, wherein the first and second plurality of ridges comprise an abradable material, wherein the first plurality of ridges is staggered relative to the second plurality of ridges.

16. The sealing arrangement of claim 8, wherein the turning portion comprises a J-shape or a hook shape.

17. The sealing arrangement of claim 8, wherein each bucket ridge of the plurality of bucket ridges comprise an angled portion.

18. The sealing arrangement of claim 17, wherein the angled portion is acutely angled to an adjacent shroud ridge of the plurality of shroud ridges.

19. A system, comprising:

a turbine bucket having an outer tip and a plurality of bucket ridges extending radially outwardly from the outer tip, wherein the plurality of bucket ridges extend along the outer tip in one or more first directions, the turbine bucket has opposite first and second sides between leading and trailing edges, each of the plurality of bucket ridges comprises a concave or convex curved portion that faces toward the first or second side, opposite ridge portions disposed along the opposite first and second sides about an intermediate space, or a combination thereof, and the at least one bucket ridge comprises an abradable material; and a stationary shroud disposed radially outwardly from the outer tip of the bucket, wherein the stationary shroud comprises at least one shroud ridge extending along an inner surface radially opposite from the outer tip.

20. The system of claim 19, wherein each of the plurality of bucket ridges comprises the concave or convex curved portion.

21. The system of claim 19, wherein the plurality of bucket ridges comprises the opposite ridge portions disposed along the opposite first and second sides about the intermediate space.

22. The system of claim 19, wherein each of the plurality of bucket ridges comprises the concave or convex curved portion and the opposite ridge portions.

23. The system of claim 19, wherein the at least one shroud ridge extends lengthwise along the inner surface in one or more second directions crosswise to the one or more first directions, and the at least one shroud ridge comprises the abradable material.

24. The system of claim 23, wherein the at least one shroud ridge comprises a plurality of shroud ridges staggered relative to the plurality of bucket ridges.

* * * * *